US008528530B2

(12) United States Patent
Freund et al.

(10) Patent No.: US 8,528,530 B2
(45) Date of Patent: Sep. 10, 2013

(54) DIESEL ENGINE SYSTEM AND CONTROL METHOD FOR A DIESEL ENGINE SYSTEM

(75) Inventors: Sebastian W. Freund, Unterfoehring (DE); Jassin Fritz, Munich (DE); Georgios Bikas, Freising (DE); Sean Jenkins, Hainhausen (DE)

(73) Assignee: General Electric Company, Niskayuna, NY (US)

( * ) Notice: Subject to any disclaimer, the term of this patent is extended or adjusted under 35 U.S.C. 154(b) by 577 days.

(21) Appl. No.: 12/827,251

(22) Filed: Jun. 30, 2010

(65) Prior Publication Data

US 2012/0000448 A1 Jan. 5, 2012

(51) Int. Cl.
*F02M 25/07* (2006.01)
*F02B 47/08* (2006.01)
*F02B 33/44* (2006.01)

(52) U.S. Cl.
USPC ..... 123/568.2; 123/58.8; 123/568.13; 123/568.21; 60/605.2

(58) Field of Classification Search
USPC ..... 123/58.8, 568.11–568.13, 568.2, 123/568.21; 60/605.2; 701/108
See application file for complete search history.

(56) References Cited

U.S. PATENT DOCUMENTS 4,131,095 A * 12/1978 Ouchi ..... 123/58.8
4,462,351 A * 7/1984 Fujii et al. ..... 123/568.27
4,506,633 A * 3/1985 Britsch ..... 123/58.8
5,203,310 A * 4/1993 Gatellier ..... 123/568.13
5,562,085 A * 10/1996 Kosuda et al. ..... 123/568.24
5,740,785 A * 4/1998 Dickey et al. ..... 123/568.24
6,877,492 B1 4/2005 Osterwald
6,957,642 B2 10/2005 Miura
7,100,431 B2 9/2006 Amman et al.
7,637,098 B2 12/2009 Persson
7,681,560 B2 3/2010 Yamaoka et al.

FOREIGN PATENT DOCUMENTS

JP 11082181 A * 3/1999 ..... 123/568.13
WO WO2004007925 A1 1/2004

* cited by examiner

*Primary Examiner* — Willis R Wolfe, Jr.
(74) *Attorney, Agent, or Firm* — Joseph J. Christian

(57) ABSTRACT

A diesel engine system includes a cylinder, an exhaust manifold, an exhaust gas recirculation (EGR) manifold, and a valve. The exhaust manifold is fluidly coupled with the cylinder and directs exhaust generated in the cylinder to an exhaust outlet that delivers the exhaust to an external atmosphere. The EGR manifold is fluidly coupled with the cylinder and recirculates the exhaust generated in the cylinder back to the cylinder as at least part of intake air that is received by the cylinder. The valve is disposed between the cylinder and the exhaust manifold and between the cylinder and the EGR manifold. The valve has a donating mode and a non-donating mode. The valve fluidly couples the cylinder with the EGR manifold when the valve is in the donating mode and fluidly couples the cylinder with the exhaust manifold when the valve is in the non-donating mode.

25 Claims, 5 Drawing Sheets

DIESEL ENGINE SYSTEM AND CONTROL METHOD FOR A DIESEL ENGINE SYSTEM

BACKGROUND OF THE INVENTION

The subject matter described herein relates generally to internal combustion engines, such as diesel engines.

Diesel engines include cylinders having combustion chambers with pistons disposed in the combustion chambers. The pistons move in the combustion chambers to rotate a shaft. The shaft may be coupled with an alternator or generator to create electric current. The electric current may be used to power one or more devices, such as traction motors of a powered rail vehicle that propel the rail vehicle.

In some known diesel engines, the pistons move within the combustion chambers based on a four-stroke cycle. During the four-stroke cycle, intake air is directed into the combustion chambers and is compressed and thereby heated to ignite diesel fuel sprayed into the combustion chamber towards the end of the compression stroke. The combustion of the diesel fuel creates a gaseous exhaust in the combustion chamber. The gaseous exhaust of the cylinders may include pollutants, such as nitrogen oxide (NOx) and soot. In order to reduce pollution emitted by the diesel engines, some known diesel engines attempt to change the composition of the intake air by recirculating parts of the exhaust gas back into the intake. These diesel engines may be referred to as exhaust gas recirculation (EGR) diesel engines.

In a certain configuration, an EGR diesel engine recirculates the gaseous exhaust from one or more dedicated cylinders to the other cylinders. For example, the gaseous exhaust from a first cylinder, such as an EGR donating cylinder, may be recirculated back to a set of different, second cylinders and form at least a part of the intake air that is received by the second cylinders and used to ignite the diesel fuel in the second cylinders.

In such an EGR donor engine, typically a fixed number of exhaust gas donating cylinders are provided. The amount of exhaust that is recirculated by the fixed number of donating cylinders may be unable to adapt to changing load demands of the engine or changing emissions limits.

BRIEF DESCRIPTION OF THE INVENTION

In one embodiment, a diesel engine system is provided. The system includes a cylinder, an exhaust manifold, an exhaust gas recirculation (EGR) manifold, and a valve. The cylinder has a piston disposed within a combustion chamber with the combustion chamber receiving intake air and fuel to combust the fuel and move the piston within the combustion chamber. The exhaust manifold is fluidly coupled with the cylinder and directs exhaust generated in the combustion chamber to an exhaust outlet that delivers the exhaust to an external atmosphere. The EGR manifold is fluidly coupled with the cylinder and recirculates the exhaust generated in the combustion chamber back to the combustion chamber as at least part of the intake air that is received by the combustion chamber. The valve is disposed between the combustion chamber of the cylinder and the exhaust manifold and between the combustion chamber and the EGR manifold. The valve has a donating mode and a non-donating mode. The valve fluidly couples the combustion chamber with the EGR manifold when the valve is in the donating mode and fluidly couples the combustion chamber with the exhaust manifold when the valve is in the non-donating mode.

In another embodiment, a control method for a diesel engine system is provided. The method includes directing exhaust generated in a combustion chamber of a cylinder in the diesel engine system to a valve disposed between and fluidly coupled with the combustion chamber and each of an exhaust manifold and an exhaust gas recirculation (EGR) manifold. The valve is switchable between a donating mode and a non-donating mode. The method includes directing the exhaust from the cylinder through the exhaust manifold to an external atmosphere when the valve is in the non-donating mode. The method includes recirculating the exhaust back to the combustion chamber through the EGR manifold as at least part of intake air that is injected into the combustion chamber when the valve is in the donating mode.

In another embodiment, a tangible and non-transitory computer readable storage medium comprising instructions for a control module of a diesel engine system is provided. The instructions direct the control module to monitor at least one of an efficiency parameter, an emissions parameter, or an operating condition of a cylinder of the diesel engine system that has a piston disposed in a combustion chamber and that receives intake air and diesel fuel to combust the diesel fuel and move the piston. The instructions further direct the control module to switch a valve between a non-donating mode and a donating mode based on the at least one of the efficiency parameter, the emissions parameter, or the operating condition. The valve is disposed between the combustion chamber of the cylinder and is fluidly coupled with the combustion chamber and each of an exhaust manifold and an exhaust gas recirculation (EGR) manifold. The valve is switchable between a donating mode and a non-donating mode. When the valve is in the non-donating mode, exhaust generated in the combustion chamber is directed through the exhaust manifold to an external atmosphere. When the valve is in the donating mode, the exhaust is recirculated back to the combustion chamber through the EGR manifold as at least part of the intake air that is injected into the combustion chamber.

DETAILED DESCRIPTION OF THE INVENTION

Figure 1:
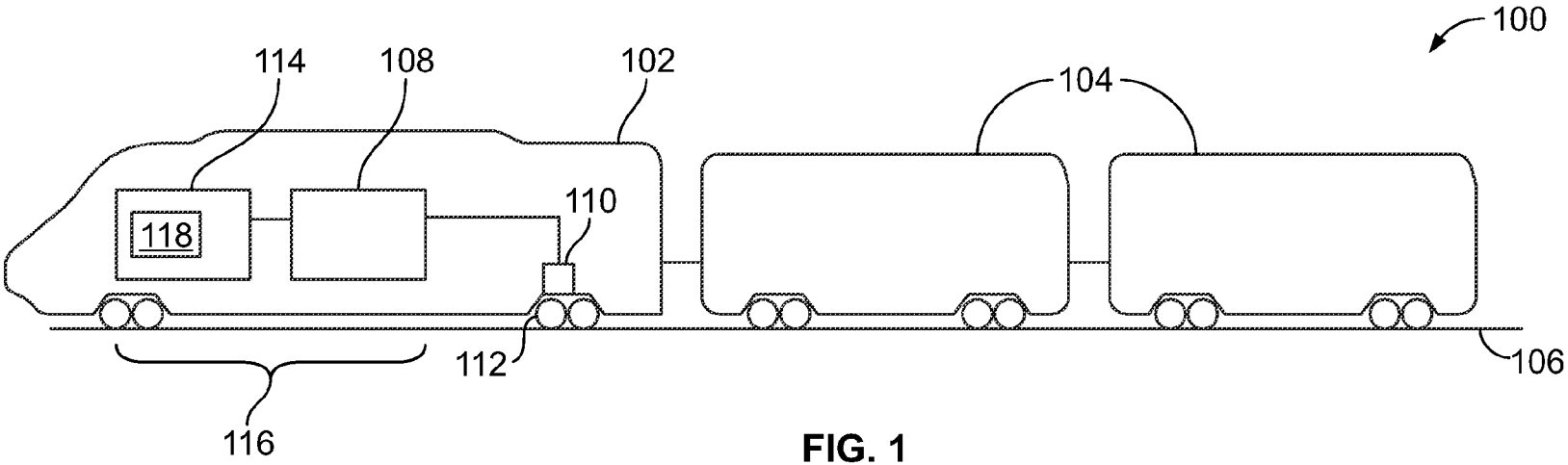
FIG. 1 is a diagram of a powered rail vehicle in accordance with one embodiment.

The foregoing summary, as well as the following detailed description of certain embodiments of the presently described subject matter, will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece or multiple pieces of hardware (for example, a general purpose signal processor, microcontroller, random access memory, hard disk, and the like). Similarly, the programs may be stand alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the presently described subject matter are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

It should be noted that although one or more embodiments may be described in connection with powered rail vehicle systems having locomotives with trailing passenger or cargo cars, the embodiments described herein are not limited to trains. In particular, one or more embodiments may be implemented in connection with different types of vehicles. For example, one or more embodiments may be implemented with a vehicle that travels on one or more rails, such as single locomotives and railcars, powered ore carts and other mining vehicles, light rail transit vehicles, and other vehicles, such as automobiles, ships, and the like.

Example embodiments of systems and methods for controlling an exhaust gas recirculation (EGR) diesel engine are provided. As described below, one or more of these embodiments provides for a system and method that changes the number of cylinders in the EGR diesel engine that donate, or recirculate, the exhaust generated by the cylinders to other non-donating cylinders. The non-donating cylinders use the exhaust from the donating cylinders as at least part of the intake air that is received by the non-donating cylinders and used to ignite diesel fuel in the non-donating cylinders. The number of cylinders that are donating cylinders and that recirculate the exhaust generated by the donating cylinders to the non-donating cylinders may be based on a number of factors, including an efficiency parameter, an emissions parameter, and/or other operating conditions of the donating and/or non-donating cylinders. At least one technical effect described herein includes a system and method that reduces the emissions of pollutants without significant loss of efficiency of the diesel engine in order to meet efficiency and/or emissions limits under varying load, speed, pressure, and/or temperature conditions of the diesel engine.

FIG. 1 is a diagram of a powered rail vehicle 100 in accordance with one embodiment. While one embodiment of the presently described subject matter is set forth in terms of a powered rail vehicle, alternatively the subject matter may be used with another type of vehicle, such as an automobile, a truck, a ship, and the like. The rail vehicle 100 includes a lead powered unit 102 coupled with several trailing cars 104 that travel along one or more rails 106. In one embodiment, the lead powered unit 102 is a locomotive disposed at the front end of the rail vehicle 100 and the trailing cars 104 are cargo cars for carrying passengers and/or other cargo. The lead powered unit 102 includes a diesel engine system 116. The diesel engine system 116 provides tractive effort to propel the rail vehicle 100. The diesel engine system 116 includes a diesel engine 108 that powers traction motors 110 coupled with wheels 112 of the rail vehicle 100. For example, the diesel engine 108 may rotate a shaft 318 (shown in FIG. 2) that is coupled with an alternator or generator (not shown). The alternator or generator creates electric current based on rotation of the shaft 318. The electric current is supplied to the traction motors 110, which turn the wheels 112 and propel the rail vehicle 100.

The rail vehicle 100 includes a control module 114 that is communicatively coupled with the diesel engine 108. For example, the control module 114 may be coupled with the diesel engine 108 by one or more wired and/or wireless connections. The control module 114 communicates with switching valve sets 224 (shown in FIG. 3) to direct the exhaust generated by one or more donating cylinders 202 (shown in FIG. 3) of the diesel engine 108. The control module 114 manages the switching valve sets 224 to control which of the donating cylinders 202 are generating exhaust that is recirculated back to other non-donating cylinders 200 (shown in FIG. 3) of the diesel engine 108 and which of the donating cylinders 202 are generating exhaust that is directed away from the non-donating cylinders 200 and out of the diesel engine 108 in one embodiment.

The control module 114 may include a processor, such as a computer processor, controller, microcontroller, or other type of logic device, that operates based on sets of instructions stored on a tangible and non-transitory computer readable storage medium 118. The computer readable storage medium 118 may be an electrically erasable programmable read only memory (EEPROM), simple read only memory (ROM), programmable read only memory (PROM), erasable programmable read only memory (EPROM), FLASH memory, a hard drive, or other type of computer memory.

Figure 2:
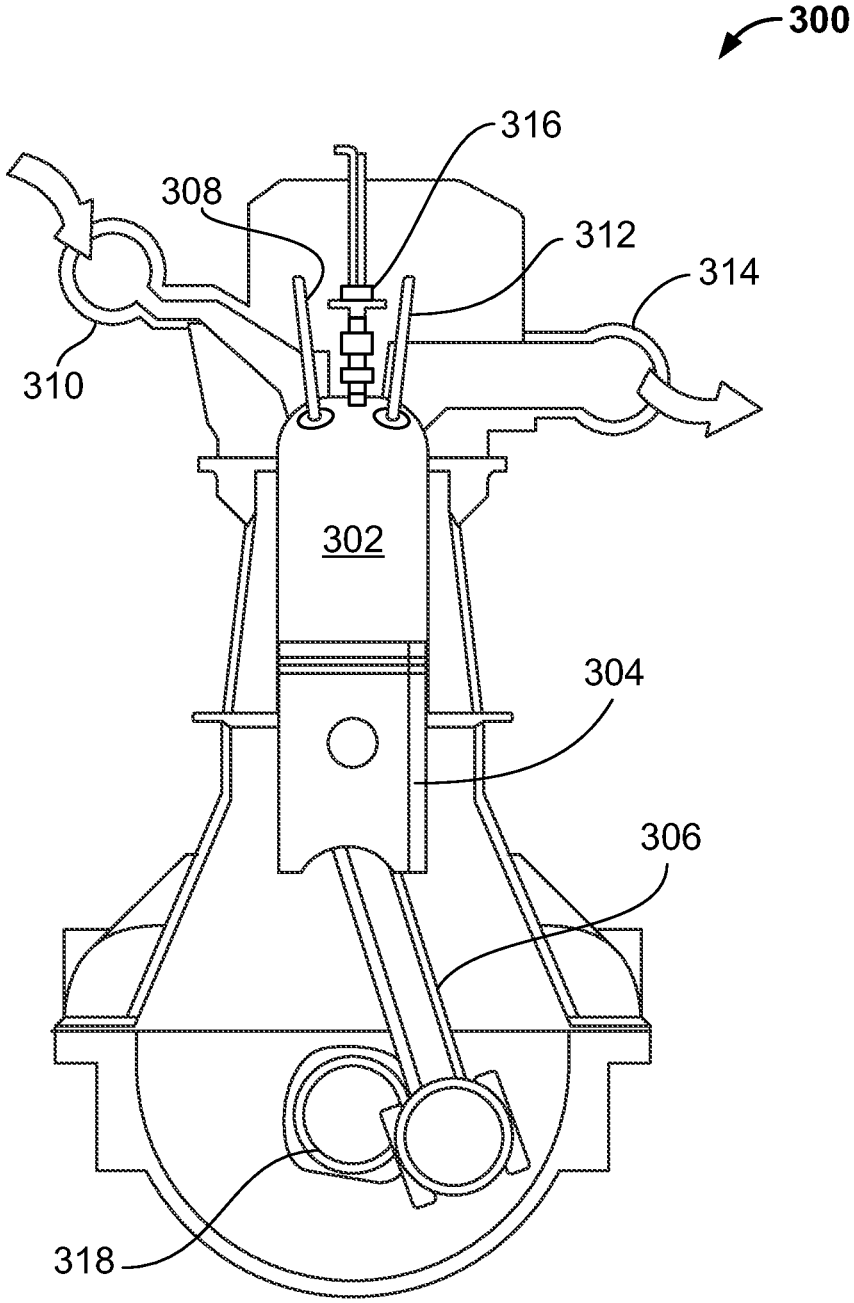
FIG. 2 is an illustration of a cylinder of a diesel engine shown in FIG. 1 in accordance with one embodiment.

FIG. 2 is an illustration of a cylinder 300 of the diesel engine 108 in accordance with one embodiment. The diesel engine 108 includes two or more cylinders 300 that operate to rotate the shaft 318. Rotation of the shaft 318 may be used to generate tractive power for the rail vehicle 100 (shown in FIG. 1). For example, rotation of the shaft 318 may create electric current, which powers the traction motors 110 (shown in FIG. 1). The cylinder 300 includes a combustion chamber 302 with a piston 304 disposed within the combustion chamber 302. In the view shown in FIG. 2, the piston 304 moves up and down within the combustion chamber 302. The piston 304 is coupled to the shaft 318 by a crankshaft 306. The crankshaft 306 converts the movement of the piston 304 in the combustion chamber 302 into rotation of the shaft 318. In one embodiment, the shaft 318 is a common shaft that several pistons 304 of the diesel engine 108 are joined.

The cylinder 300 includes an intake valve 308 that opens to permit intake air to enter into the combustion chamber 302 and closes to prevent additional intake air from entering the combustion chamber 302. For example, the cylinder 300 may include an inlet conduit 310 that directs intake air to the combustion chamber 302. The intake valve 308 is disposed between the combustion chamber 302 and the inlet 310. The intake valve 308 opens to allow intake air into the combustion chamber 302 and closes to prevent intake air from leaving the combustion chamber 302.

The cylinder 300 includes an exhaust valve 312 that opens to direct gaseous exhaust out of the combustion chamber 302 and closes to prevent the gaseous exhaust and/or intake air from exiting the combustion chamber 302. The cylinder 300 may include an outlet conduit 314 that directs the exhaust out of the combustion chamber 302. The exhaust valve 312 opens to allow gaseous exhaust in the combustion chamber 302 to exit the combustion chamber 302 into the outlet conduit 314.

The cylinder 300 includes a fuel injector 316 that directs fuel, such as diesel fuel, into the combustion chamber 302. The fuel injector 316 is disposed between a source or supply of fuel (not shown), such as a fuel tank and fuel pump, and the combustion chamber 302. The fuel injector 314 injects or sprays the fuel into the combustion chamber 302.

The cylinder 300 may operate based on a multi-stroke cycle in one embodiment. The piston 304 moves within the combustion chamber 302 during the multi-stroke cycle to rotate the shaft 318. In one embodiment, the multi-stroke cycle is a four-stroke cycle that includes an intake stroke, a compression stroke, a combustion stroke, and an exhaust stroke. Alternatively, the cylinder 300 may operate based on a different cycle. During the intake stroke, the inlet valve 308 opens to direct intake air into the combustion chamber 302. The influx of intake air into the combustion chamber 302 drives the piston 304 away from the inlet valve 308 and toward the shaft 318. In the illustrated embodiment, the intake air moves the piston 304 downward.

Following the intake stroke is the compression stroke. During the compression stroke, the piston 304 moves in an opposite direction toward the fuel injector 316. For example, in the illustrated embodiment, the piston 304 moves upward toward the top of the combustion chamber 302. The intake and exhaust valves 308, 312 remain closed during the compression stroke. As the piston 304 moves upward, the volume in the combustion chamber 302 decreases while the intake air in the combustion chamber 302 remains the same. As a result, the intake air in the combustion chamber 302 is compressed by the piston 304. The compression of the intake air heats the intake air inside the combustion chamber 302.

Following the compression stroke is the combustion stroke. During the combustion stroke, diesel fuel is injected into the combustion chamber 302 by the fuel injector 316. For example, as the piston 304 reaches or approaches the top of the combustion chamber 302, the fuel injector 316 may spray diesel fuel into the combustion chamber 302 in the illustrated embodiment. The compressed and heated intake air in the combustion chamber 302 ignites the diesel fuel in the combustion chamber 302. The ignition of the diesel fuel creates increased pressure within the combustion chamber 302 and forces the piston 304 away from the fuel injector 316. For example, the combustion of the diesel fuel may force the piston 304 downward in the view shown in FIG. 2.

Following the combustion stroke is the exhaust stroke. The combustion of the diesel fuel within the combustion chamber 302 generates gaseous exhaust in the combustion chamber 302. The gaseous exhaust may include pollutants such as nitrogen oxide (NOx). During the exhaust stroke, the piston 304 moves back up toward the fuel injector 316 and the exhaust valve 312 opens to direct the gaseous exhaust out of the combustion chamber 302. For example, the exhaust valve 312 may open to permit the gaseous exhaust to flow from the combustion chamber 302 into the outlet conduit 314.

Figure 3:
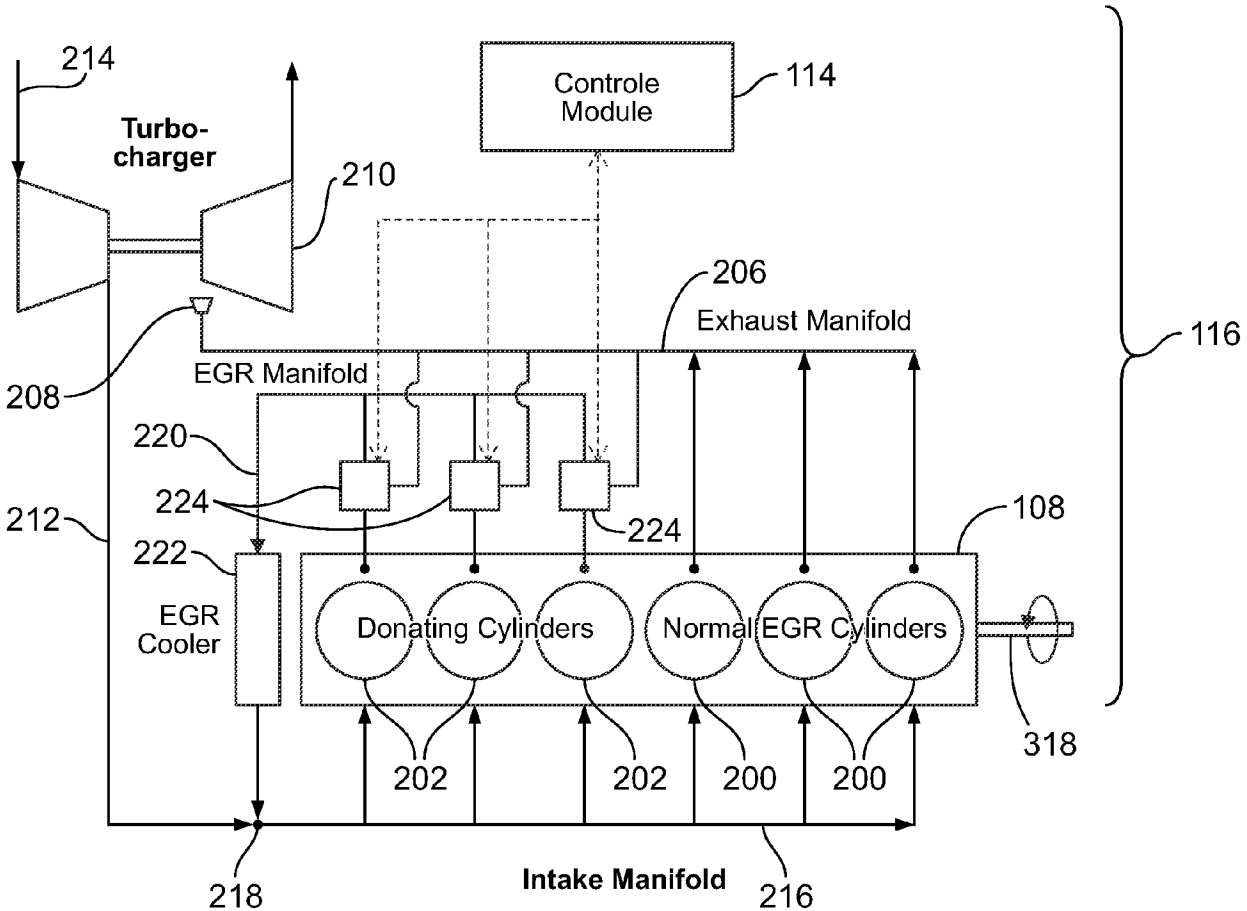
FIG. 3 is a diagram of a diesel engine system shown in FIG. 1 in accordance with one embodiment.

FIG. 3 is a diagram of the diesel engine system 116 in accordance with one embodiment. The diesel engine system 116 includes the diesel engine 108 coupled with the control module 114. In the illustrated embodiment, the diesel engine 108 is communicatively coupled with the diesel engine 108 by one or more wired and/or wireless connections. The dashed lines extending between the switching valve sets 224 of the diesel engine 108 and the control module 114 illustrate at least one communication path between the control module 114 and the diesel engine 108.

The diesel engine 108 includes several cylinders 200, 202, referred to herein as non-donating cylinders 200 ("normal non-donating cylinders") and donating cylinders 202. The non-donating cylinders 200 may be referred to as exhaust gas recirculation (EGR) cylinders. In the illustrated embodiment, the diesel engine 108 includes three non-donating cylinders 200 and three donating cylinders 202. Alternatively, the diesel engine 108 may include a different number of the non-donating and/or donating cylinders 200, 202. The non-donating cylinders 200 and donating cylinders 202 may be similar to the cylinder 300 described in connection with FIG. 2. For example, each of the non-donating and donating cylinders 200, 202 may include pistons 304 (shown in FIG. 2) that move within combustion chambers 302 (shown in FIG. 3) based on a multi-stroke cycle to rotate the shaft 318.

In the illustrated embodiment, the non-donating cylinders 200 are fluidly coupled with an exhaust manifold 206. For example, the outlet conduits 314 (shown in FIG. 2) of the non-donating cylinders 200 may be coupled with the exhaust manifold 206 such that gaseous and/or liquid matter, such as gaseous exhaust, flows from the outlet conduits 314 to the exhaust manifold 206. The exhaust manifold 206 includes one or more conduits that direct gaseous exhaust from the non-donating cylinders 200 away from the diesel engine 108. The exhaust manifold 206 includes an exhaust outlet 208. The exhaust outlet 208 may be an opening at an end of the exhaust manifold 206 that directs exhaust from the diesel engine 108 to an external atmosphere. For example, the exhaust outlet 208 may be disposed at a terminal end of the exhaust manifold 206 that directs the exhaust to a turbocharger 210.

The turbocharger 210 may use the exhaust to draw in and pump ambient air 214 from the external atmosphere into an input manifold 212. After the exhaust is used by the turbocharger 210, the exhaust may be emitted into the environment outside of the diesel engine 108 and/or turbocharger 210. Alternatively, the exhaust outlet 208 may direct the exhaust to the external atmosphere without directing the exhaust to the turbocharger 210. For example, the exhaust outlet 208 may direct the exhaust to an area or volume that is not disposed within the diesel engine 108. By directing the exhaust to the external atmosphere, the exhaust outlet 208 prevents the exhaust from being recirculated back to the donating and/or non-donating cylinders 202, 202 within the diesel engine 108 in one embodiment.

The input manifold 212 is fluidly coupled with an intake manifold 216 of the diesel engine system 116 by an EGR intake junction 218. The input manifold 212 receives the ambient air 214 from the turbocharger 210 and directs the ambient air 214 to the EGR intake junction 218.

The donating cylinders 202 are fluidly coupled with an EGR manifold 220. For example, the outlet conduits 314 (shown in FIG. 2) of the donating cylinders 202 may be coupled with the EGR manifold 220 such that gaseous and/or liquid matter, such as gaseous exhaust, flows from the outlet conduits 314 to the EGR manifold 220. The EGR manifold 220 includes one or more conduits that direct exhaust from the donating cylinders 202 to an EGR cooler 222. The EGR cooler 222 is a device that reduces the temperature or thermal energy of the gaseous exhaust from the donating cylinders 202. For example, the EGR cooler 222 may include one or more heat exchangers, compressors, or fans that cool the exhaust from the donating cylinders 202. The EGR cooler 222 is fluidly coupled with the EGR intake junction 218. The EGR intake junction 218 fluidly couples the input manifold 212 with the EGR cooler 222 such that the exhaust of the donating cylinders 202 that is cooled by the EGR cooler 222 can be mixed with the ambient air 214 from the input manifold 212.

The mixture of ambient air and the cooled exhaust may be referred to as "intake air," or the air that is received by the non-donating and/or donating cylinders 200, 202 and used by the non-donating and/or donating cylinders 200, 202 to combust diesel fuel. The intake air is directed by the EGR intake junction 218 into the intake manifold 216. The intake manifold 216 is fluidly coupled with the non-donating and donating cylinders 200, 202 and directs the intake air to the non-donating and donating cylinders 200, 202 in the illustrated embodiment. For example, the intake manifold 216 may be coupled with the inlet conduits 310 (shown in FIG. 2) of the non-donating and donating cylinders 200, 202 such that the intake air flows through and is directed by the intake manifold 216 and inlet conduits 310 into the combustion chambers 302 (shown in FIG. 2) of the non-donating and donating cylinders 200, 202.

The switching valve sets 224 include one or more valves that are fluidly coupled with the donating cylinders 202, the EGR manifold 220, and the exhaust manifold 206. For example, the switching valve sets 224 are fluidly coupled with the donating cylinders 202, the EGR manifold 220, and the exhaust manifold 206 such that a gas or liquid may flow from the donating cylinders 202 to the EGR manifold 220 and/or the exhaust manifold 206 through the switching valve sets 224. The switching valve sets 224 may include a three-way valve, two or more two-way valves, or other valves or groups of valves. In one embodiment, the switching valve sets 224 each include a plurality of two-way valves that restrict the flow of exhaust through each two-way valve in a complementary manner. For example, a first two-way valve may permit only 40% of the exhaust to pass through the two-way valve while a second two-way valve permits 60% of the exhaust to pass through.

In the illustrated embodiment, the switching valve sets 224 are disposed between the donating cylinders 202 and each of the exhaust manifold 206 and the EGR manifold 220. For example, the switching valve sets 224 are disposed downstream of the donating cylinders 202 and upstream of the exhaust manifold 206 and the EGR manifold 220 along a path that the exhaust of the donating cylinders 202 flows.

The switching valve sets 224 alternate between different modes to direct the exhaust from the donating cylinders 202 along different paths. For example, the switching valve sets 224 may have a donating mode and a non-donating mode. In the donating mode, the switching valve sets 224 fluidly couple the donating cylinders 202 with the EGR manifold 220. By fluidly coupling the donating cylinders 202 with the EGR manifold 220, the exhaust generated by the donating cylinders 202 is directed to the EGR manifold 220. As a result, the exhaust is recirculated back to the non-donating and donating cylinders 200, 202 as at least part of the intake air of the non-donating and donating cylinders 200, 202. For example, the switching valve sets 224 direct the exhaust from the donating cylinders 202 to the EGR manifold 220, which directs the exhaust to the EGR cooler 222 and the intake manifold 216 by way of the EGR intake junction 218.

The switching valve sets 224 may prevent flow of exhaust to the exhaust manifold 206 when the switching valve sets 224 are in the donating mode. For example, the switching valve sets 224 may block flow of the exhaust from the donating cylinders 202 from passing into the exhaust manifold 206. Alternatively, the switching valve sets 224 may controllably restrict the flow of exhaust into the exhaust manifold 206. The switching valve sets 224 may be controlled by the control module 114 to direct some, but not all, of the exhaust into the exhaust manifold 206. The remaining portion of the exhaust may be directed into the EGR manifold 220 by the switching valve sets 224. For example, the switching valve sets 224 may direct 5%, 10%, 20%, 30%, 40%, 50%, and the like, of the exhaust flowing out of one or more donating cylinders 202 into the exhaust manifold 206 while the corresponding remaining 95%, 90%, 80%, 70%, 60%, 50%, and the like, of the exhaust is recirculated into the EGR manifold 220. The switching valve sets 224 may change between the donating and non-donating modes by adjusting the percentage of exhaust that is directed by the switching valve sets 224 to the EGR manifold 220 or the exhaust manifold 206.

In the non-donating mode, the switching valve sets 224 fluidly couple the donating cylinders 202 with the exhaust manifold 206. By fluidly coupling the donating cylinders 202 with the exhaust manifold 206, the exhaust generated by the donating cylinders 202 is directed to the exhaust manifold 206. As a result, the exhaust is directed out of the diesel engine 108 and into the turbocharger 210. The exhaust may pass through the turbocharger 210 and be expelled out of the turbocharger 210 and into the external atmosphere.

The switching valve sets 224 may prevent flow of exhaust to the EGR manifold 220 when the switching valve sets 224 are in the non-donating mode. For example, the switching valve sets 224 may block flow of the exhaust from the donating cylinders 202 from passing into the EGR manifold 220 and being recirculated to the donating and/or non-donating cylinders 202, 200. Alternatively, the switching valve sets 224 may controllably restrict the flow of exhaust into the EGR manifold 220. For example, the switching valve sets 224 may recirculate 5%, 10%, 20%, 30%, 40%, 50%, and the like, of the exhaust flowing out of one or more donating cylinders 202 into the EGR manifold 220 while the remaining 95%, 90%, 80%, 70%, and the like, of the exhaust is emitted into the external atmosphere through into the exhaust manifold 206 and the turbocharger 210.

The switching valve sets 224 may include one or more stop valves and/or check valves. For example, the switching valve sets 224 may include one or more two-way valves, three-way valves, globe valves, gate valves, butterfly valves, ball valves, and the like. In one embodiment, the switching valve sets 224 include a throttle valve that decreases pressure losses in the exhaust flowing from the donating cylinders 202 to the EGR manifold 220.

Figure 4:
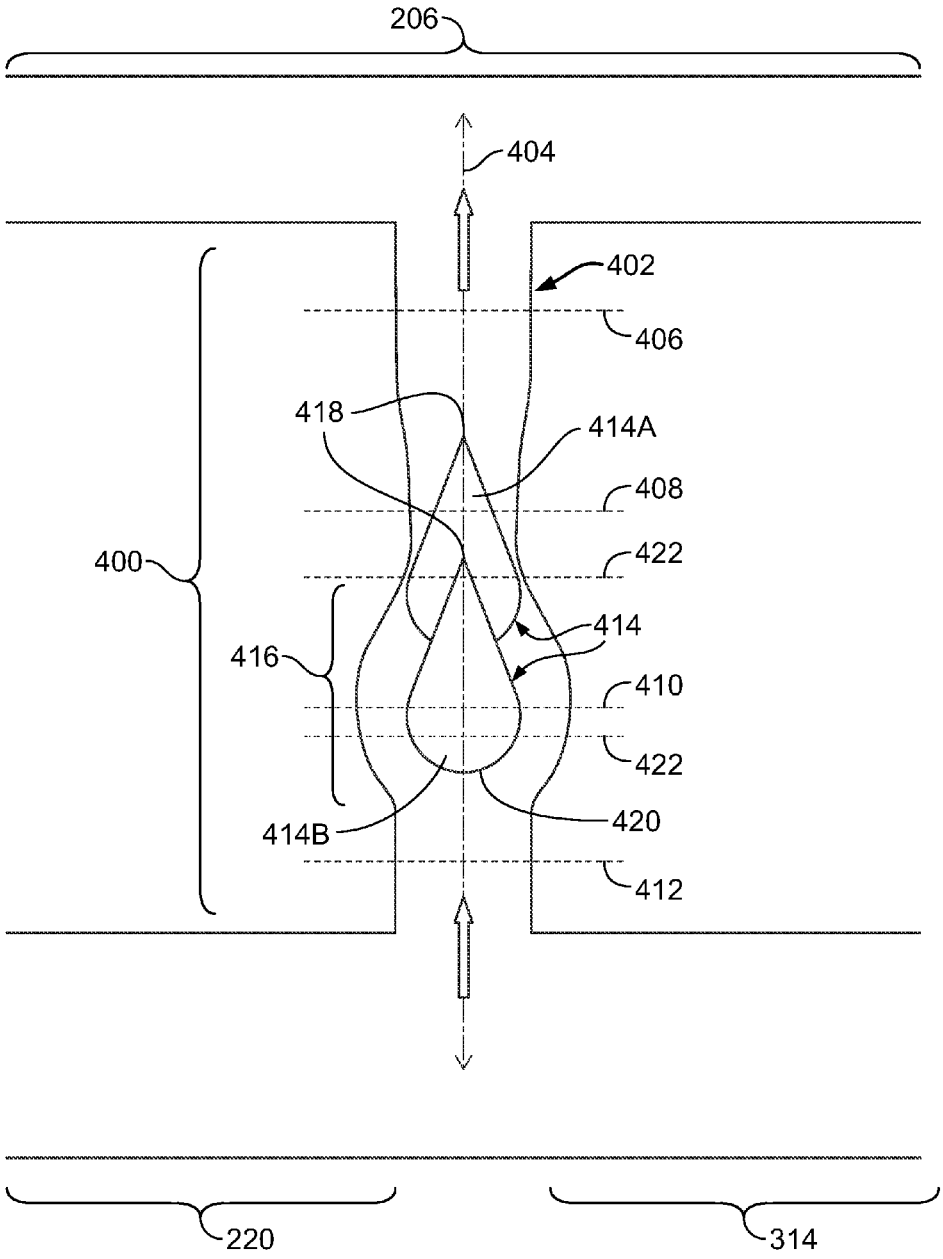
FIG. 4 is a cross-sectional view of a throttle valve in accordance with one embodiment.

FIG. 4 is a cross-sectional view of a throttle valve 400 in accordance with one embodiment. The throttle valve 400 may be used for one or more of the switching valve sets 224 (shown in FIG. 3) or in combination with one or more other valves to collectively form one or more of the switching valve sets 224. For example, the throttle valve 400 may be combined with a two-way valve to control the flow of exhaust from the donating cylinder 202 (shown in FIG. 3) to the exhaust manifold 206 (shown in FIG. 3) and/or EGR manifold 220 (shown in FIG. 3). Alternatively, a valve other than the throttle valve 400 may be used for one or more of the switching valve sets 224.

The throttle valve 400 may be fluidly coupled with the exhaust manifold 206, the outlet conduit 314 of the donating cylinder 202 (shown in FIG. 3), and the EGR manifold 220. For example, when the throttle valve 400 is in the non-donating mode, the throttle valve 400 is disposed downstream of the outlet conduit 314 and upstream of the exhaust manifold 206 along the path that the exhaust flows from the donating cylinder 202 to the exhaust manifold 206.

The throttle valve 400 includes a conduit 402 with a plug 414 disposed inside the conduit 402. In one embodiment, the exhaust from the donating cylinder 202 (shown in FIG. 3) flows through the conduit 402 to the exhaust manifold 206 when the throttle valve 400 is in the non-donating mode. Alternatively, the exhaust may flow through the conduit 402 to the EGR manifold 220 when the throttle valve 400 is in the donating mode. The conduit 402 is elongated over a longitudinal axis 404 and has a cross-sectional shape that changes at different locations 406, 408, 410, 412 along the longitudinal axis 404 in the illustrated embodiment. For example, the conduit 402 shown in FIG. 4 has approximately the same cross-sectional shape or area at upper and lower locations 406, 408. The upper location 406 is disposed between the plug 414 and the exhaust manifold 206 and the lower location 412 is disposed between the plug 414 and the outlet conduit 314 of the donating cylinder 202.

The cross-sectional shape of the conduit 402 extends outward to a bulb 416 disposed between the upper and lower locations 406, 412. In the illustrated embodiment, the cross-sectional area of the conduit 402 is larger within the bulb 416 than in the remainder of the conduit 402. For example, the conduit 402 may have a larger cross-sectional area at a distended location 410 that is located within the bulb 416 of the conduit 402 than at the upper and lower locations 406, 412. The conduit 402 may have a smaller cross-sectional area at a reduced location 408. For example, the cross-sectional area of the conduit 402 at the reduced location 408 between the bulb 416 and the upper location 406 may be smaller than the cross-sectional area of the conduit 402 at the other locations 406, 410, 412.

The plug 414 has a conical body in the illustrated embodiment. For example, the plug 414 may have an approximate shape of a tear drop with the plug 414 having an elongated conical body extending along the longitudinal axis 404 from a tip end 418 to an opposite end 420. As shown in FIG. 4, the cross-sectional area of the plug 414 may increase along the length of the plug 414 from the cross-sectional area at the tip end 418 to a cross-sectional area at a blocking location 422 of the plug 414. The cross-sectional area may decrease along the length of the plug 414 from the blocking location 422 to the opposite end 420, with the cross-sectional area at the opposite end 420 being larger than the cross-sectional area at the tip end 418.

The plug 414 is shown in two locations in FIG. 4. The plug 414 is labeled as plug 414A in a closed position and as plug 414B in an open position. The plug 414 is moved between the open and closed positions to switch between the non-donating and donating modes in the illustrated embodiment. For example, the plug 414A is in a closed position when the throttle valve 400 is in the donating mode. When the plug 414A is in the closed position, the plug 414A engages the conduit 402 to shut off flow of the exhaust from the outlet conduit 314 of the donating cylinder 202 (shown in FIG. 3) to the exhaust manifold 206. As a result, the exhaust from the outlet conduit 314 is directed to the EGR manifold 220.

The plug 414B is in an open position when the throttle valve 400 is in the non-donating mode in one embodiment. When the plug 414B is in the open position, the plug 414B does not engage the conduit 402 to block flow of the exhaust to the exhaust manifold 206. As a result, the exhaust can flow from the outlet conduit 314 to the exhaust manifold 206.

In order to reduce pressure losses caused by the switching valve sets 224 (shown in FIG. 3) being disposed between the exhaust manifold 206 and the EGR manifold 220, the throttle valve 400 may be used. For example, the switching valve sets 224 may be subjected to backpressure due to the flow of exhaust along the exhaust manifold 206 from the non-donating cylinders 200 (shown in FIG. 3) and/or other donating cylinders 202 (shown in FIG. 3). The pressure of the exhaust in the EGR manifold 220 may be greater than the pressure of the exhaust in the exhaust manifold 206. As a result, the greater backpressure in the EGR manifold 220 may cause the exhaust to be split between flowing to the exhaust manifold 206 and the EGR manifold 220 when a valve located between the exhaust manifold 206 and the EGR manifold 220 is opened. Consequently, a pressure loss of the exhaust flowing to the exhaust manifold 206 may occur and the flow rate of exhaust that passes into the exhaust manifold 206 can be decreased.

The shape of the conduit 402 and/or plug 414 of the throttle valve 400 may reduce these pressure losses when the throttle valve 400 is switched from the donating mode (shown as plug 414B) to the non-donating mode (shown as plug 414A). When the plug 414B is in the closed position, the plug 414B engages the conduit 402 and blocks exhaust from flowing to the exhaust manifold 206. As exhaust flows from the outlet conduit 314 to the EGR manifold 220, the pressure of the exhaust in the conduit 402 of the throttle valve 400 may build up. For example, the pressure of the exhaust in the bulb 416 of the conduit 402 may increase. The plug 414B may be moved to the position represented by the plug 414A to switch the throttle valve 400 from the donating mode to the non-donating mode. As the plug 414B is moved to the position of the plug 414A, the built-up pressure in the bulb 416 flows into the upper portion of the conduit 402, or the portion of the conduit 402 between the bulb 416 and the exhaust manifold 206. The exhaust flowing from the outlet conduit 314 may then flow into the exhaust manifold 206 instead of being split between the exhaust manifold 206 and the EGR manifold 220.

The control module 114 (shown in FIG. 1) controls the position of the plug 414 inside the conduit 402 in one embodiment. For example, the plug 414 may be coupled with a motor or other device (not shown) that moves the plug 414 along the longitudinal axis 404 in response to commands received from the control module 114. The control module 114 may move the plug 414 to positions located between the positions represented by plug 414A and plug 414B. For example, the control module 114 may move the plug 414 to a position between the positions of plug 414A and plug 414B. Depending on the position of the plug 414 between the positions of plug 414A and plug 414B, the rate of flow of the exhaust into the exhaust manifold 206 and/or the EGR manifold 220 may be controlled by the control module 114. For example, as the plug 414 moves from the position of plug 414A toward the position of plug 414B, the gap between the plug 414 and the conduit 402 increases. As the gap between the plug 414 and the conduit 402 increases, the rate at which the exhaust flows into the exhaust manifold 206 increases while the rate that the exhaust flows into the EGR manifold 220 decreases in one embodiment.

Returning to the discussion of the diesel engine system 116 shown in FIG. 3, the control module 114 manages which mode the switching valve sets 224 operate within the donating mode or non-donating mode in one embodiment. For example, the control module 114 may alternate the switching valve sets 224 between the donating mode and the non-donating mode during a trip along a route by the rail vehicle 100 (shown in FIG. 1). The control module 114 may communicate with and controls which of the switching valve sets 224 are in the donating mode and which of the switching valve sets 224 are in the non-donating mode to manage the efficiency and/or emissions of the diesel engine 108. The control module 114 may base the number of switching valve sets 224 that are in each of the donating and non-donating modes based on at least one of an efficiency parameter, an emissions parameter, and/or an operating condition of the diesel engine 108.

In one embodiment, the control module 114 manages the fraction or percentage of exhaust that is recirculated by the switching valve sets 224. For example, instead of blocking all flow of exhaust from being recirculated when the switching valve sets 224 are in the non-donating mode, the control module 114 may cause one or more of the switching valve sets 224 to direct some of the exhaust out of the diesel engine 108

(shown in FIG. 1) through the turbocharger 210 (shown in FIG. 2) while recirculating the rest of the exhaust back to the donating and non-donating cylinders 202, 200. For example, the switching valve sets 224 may be controlled by the control module 114 to direct some, but not all, of the exhaust into the exhaust manifold 206. The remaining portion of the exhaust may be directed into the EGR manifold 220 by the switching valve sets 224. For example, the switching valve sets 224 may direct 5%, 10%, 20%, 30%, 40%, 50%, and the like, of the exhaust flowing out of one or more donating cylinders 202 into the exhaust manifold 206 while the corresponding remaining 95%, 90%, 80%, 70%, 60%, 50%, and the like, of the exhaust is recirculated into the EGR manifold 220. The control module 114 may base the percentage or fraction of exhaust that is recirculated by the switching valve sets 224 back into the EGR manifold 220 based on at least one of an efficiency parameter, an emissions parameter, and/or an operating condition of the diesel engine 108.

The efficiency parameter represents a measurement or quantifiable characterization of the operation of the diesel engine 108 in one embodiment. The efficiency parameter may a measurement of an efficiency of one or more of the donating and/or non-donating cylinders 202, 200. For example, the efficiency parameter may include a measurement of the efficiency of the donating cylinders 202 in converting diesel fuel into power. The efficiency parameter may include other measurements of the performance or operation of the engine 108. In one embodiment, the efficiency parameter includes multiple measurements of the performance of the engine 108, such as measurements of the power generated by the donating cylinders 202 and/or the efficiency of the donating cylinders 202. The efficiency parameter may be measured by the control module 114.

The emissions parameter represents a measurement or quantifiable characterization of the exhaust generated by the diesel engine 108 in one embodiment. In one example, the emissions parameter includes a measurement of an exhaust volume flow rate of the gaseous exhaust flowing from one or more of the donating and/or non-donating cylinders 202, 200. The emissions parameter may be a measurement of the mass flow rate of the gaseous exhaust that flows from the donating and/or non-donating cylinders 202, 200. The exhaust volume flow rate may be measured by a sensor (not shown), such as a mass flow sensor coupled with the control module 114. The exhaust volume flow rate may be expressed as the mass of the gaseous exhaust from the donating and/or non-donating cylinders 202, 200 that passes through a surface area per unit of time.

In one example, an emissions parameter may include a measurement of a composition of one or more constituents of the gaseous exhaust generated by the diesel engine 108. For example, the emissions parameter may be a concentration of one or more pollutants in the gaseous exhaust generated by the donating and/or non-donating cylinders 202, 200, such as the concentration of nitrogen oxide (NOx).

The emissions parameter may include multiple measurements of the exhaust of the diesel engine 108. For example, the emissions parameter may include or be based on measurements of the exhaust volume flow rate of the gaseous exhaust from the donating and/or non-donating cylinders 202, 200 and the concentration of one or more constituents in the gaseous exhaust from the donating and/or non-donating cylinders 202, 200.

The operating conditions represent one or more measurements or quantifiable characterizations of the conditions under which the diesel engine 108 operates in one embodiment. In one example, the operating conditions may include a pressure and/or temperature of the exhaust generated by the donating cylinders 202 in another example.

In another example, the operating conditions may include a load demand of the diesel engine 108, or one or more of the donating and/or non-donating cylinders 202, 200. The load demand represents the power demanded or required from the diesel engine 108 or one or more of the donating and/or non-donating cylinders 202, 200. For example, the load demand may represent the horsepower required to propel the rail vehicle 100 (shown in FIG. 1) and associated cargo and/or passengers along a predetermined route. The load demand may change along the route due to variances in grades, speed limits, and the like of the route.

In another example, the operating conditions may include a speed demand of the diesel engine 108, or of one or more of the donating and/or non-donating cylinders 202, 200. The speed demand represents the speed at which the shaft 318 is demanded or required to be rotated by the diesel engine 108 or one or more of the donating and/or non-donating cylinders 202, 200. For example, the speed demand may represent the speed at which the diesel engine 108 is demanded to rotate the shaft in order to generate sufficient electric current to power the traction motors 110 (shown in FIG. 1). The speed demand may change along the route due to variances in grades, speed limits, and the like of the route.

The control module 114 may base how many of the switching valve sets 224 operate within the donating mode or non-donating mode based on one or more of an upper exhaust volume flow rate limit or a lower exhaust volume flow rate limit. The control module 114 may base the percentage or fraction of the exhaust that is recirculated to the EGR manifold 220 by the switching valve sets 224 based on one or more of an upper exhaust volume flow rate limit or a lower exhaust volume flow rate limit. The upper and/or lower exhaust volume flow rate limits may establish a range of exhaust volume flow rates that are emitted by the diesel engine system 116 through the external outlet 208. For example, the upper exhaust volume flow rate limit may be an upper limit on the rate of exhaust emissions directed into the external atmosphere by the diesel engine system 116. The lower exhaust volume flow rate limit may be a lower limit on the rate of exhaust emissions directed into the external atmosphere by the diesel engine system 116. In one embodiment, the upper and/or lower exhaust volume flow rate limits are predetermined thresholds. Alternatively, the upper and/or lower exhaust volume flow rate limits may vary based on one or more of a position of the rail vehicle 100 (shown in FIG. 1), the efficiency parameter, the emissions parameter, and/or an operating condition of the diesel engine 108. With respect to the position of the rail vehicle 100, different areas through which the rail vehicle 100 travels may have different emission limits. The upper and/or lower exhaust volume flow rate limits may be based on these different emission limits as the rail vehicle 100 travels through different areas.

Figure 5:
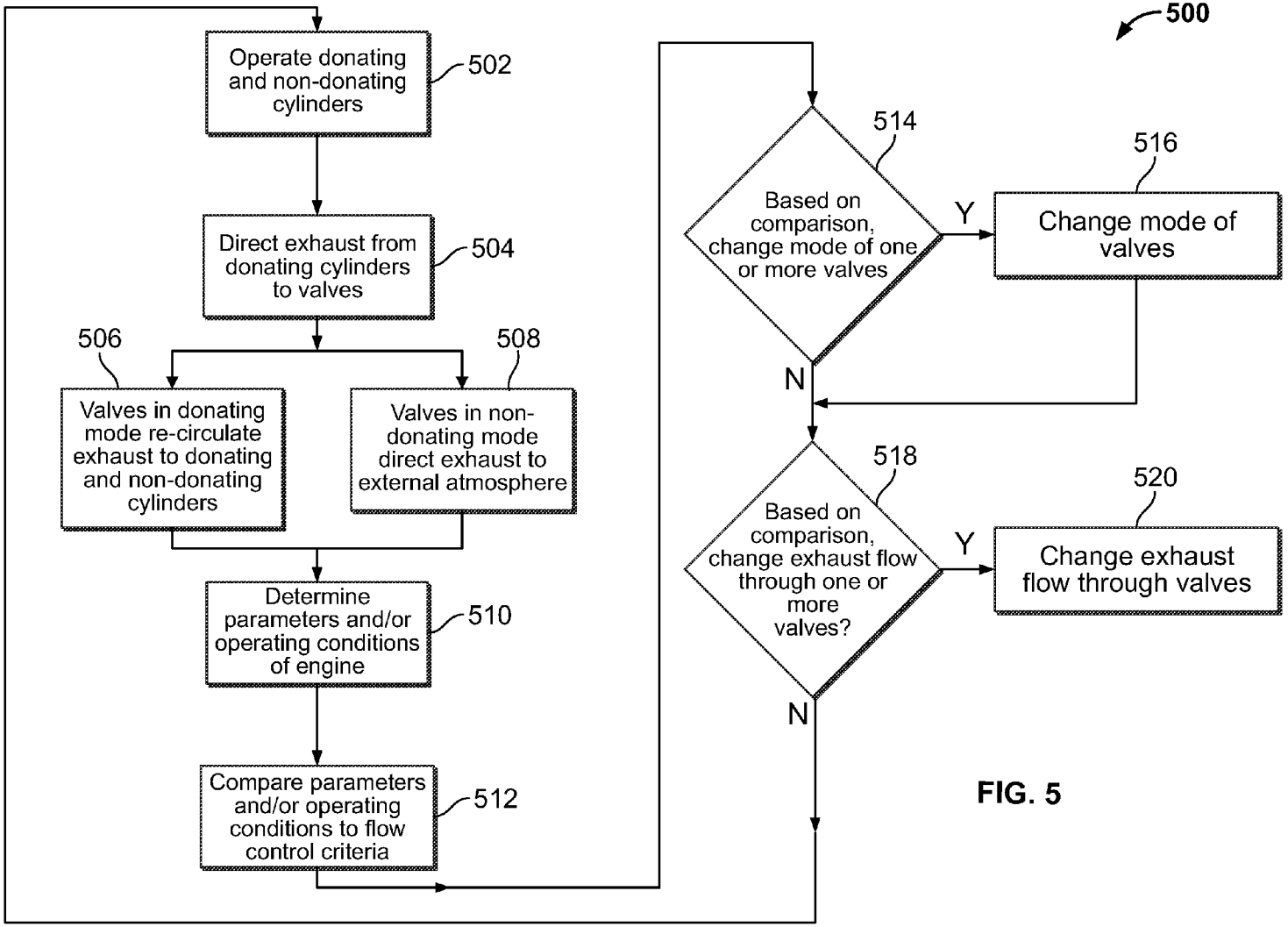
FIG. 5 is a flowchart of a control method for the diesel engine system shown in FIG. 1 in accordance with one embodiment.

FIG. 5 is a flowchart of a control method 500 for the diesel engine system 116 (shown in FIG. 1) in accordance with one embodiment. The operations described in connection with the control method 500 may be performed by the control module 114 (shown in FIG. 1) to manage which of the switching valve sets 224 (shown in FIG. 3) are operating in the donating or non-donating mode and/or the percentage or fraction of exhaust that is directed by the switching valve sets 224 (shown in FIG. 3) to the EGR manifold 220 (shown in FIG. 3) and/or the external atmosphere. At 502, one or more donating cylinders 202 (shown in FIG. 3) and one or more non-donating cylinders 200 (shown in FIG. 2) are operated to rotate the shaft 318 (shown in FIG. 2) of the diesel engine system 116. As the donating and non-donating cylinders 202, 200 operate, gaseous exhaust is generated.

At 504, the exhaust generated in the donating cylinders 202 (shown in FIG. 3) is directed to the switching valve sets 224 (shown in FIG. 3). The exhaust from the non-donating cylinders 200 (shown in FIG. 3) may be directed to the external atmosphere by way of the exhaust manifold 206 (shown in FIG. 3).

At 508 and 506, the exhaust from the donating cylinders 202 (shown in FIG. 3) is directed to the external atmosphere by way of the exhaust manifold 206 (shown in FIG. 3) and/or is recirculated back to the donating and/or non-donating cylinders 202, 200 (shown in FIG. 3). For example, the switching valve sets 224 (shown in FIG. 3) that are in the non-donating mode direct the exhaust to the exhaust manifold 206 while the switching valve sets 224 that are in the donating mode recirculate the exhaust. The exhaust may be recirculated back to the donating and/or non-donating cylinders 202, 200 and used as at least part of the intake air that is received by the donating and/or non-donating cylinders 202, 200 and used to ignite diesel fuel in the donating and/or non-donating cylinders 202, 200.

At 510, one or more parameters and/or operating conditions of the diesel engine 108 (shown in FIG. 1) are determined. For example, an efficiency parameter, an emissions parameter, and/or an operating condition such as a load demand, speed demand, exhaust pressure, and/or exhaust temperature may be determined by the control module 114 (shown in FIG. 1). Alternatively, one or more of the parameters and/or operating conditions may be measured by a sensor (not shown) and communicated to the control module 114.

At 512, the parameters and/or operating conditions are compared to flow control criteria. The flow control criteria include one or more rules or thresholds to which the parameters and/or operating conditions are compared in order to determine if the number of switching valve sets 224 (shown in FIG. 3) that are in the non-donating mode needs to change. For example, the efficiency parameter may include a measurement of the efficiency of the diesel engine 108 (shown in FIG. 1) that is compared to a threshold efficiency of the flow control criteria. In another example, the emissions parameter may include an exhaust volume flow rate that represents the flow rate of the exhaust flowing from the donating and/or non-donating cylinders 202, 200 (shown in FIG. 3). The exhaust volume flow rate may be compared to an upper and/or lower exhaust volume flow rate limit. The load demand may be compared to a load threshold. The speed demand may be compared to a speed threshold. In another example, the temperature of the exhaust generated by the donating cylinders 202 may be compared to a temperature threshold. In another example, the pressure of the exhaust generated by the donating cylinders 202 may be compared to a pressure threshold.

At 514, a determination is made whether to change the number of switching valve sets 224 (shown in FIG. 3) that are in the non-donating mode to the donating mode. For example, based on the comparison of the parameters and/or conditions to the flow control criteria, the set of switching valve sets 224 that are in the non-donating mode may need to be changed. In one embodiment, if the efficiency parameter includes an efficiency measurement of the diesel engine 108 (shown in FIG. 1) that exceeds an efficiency threshold, then the efficiency measurement may indicate that the diesel engine 108 is operating at a sufficiently high efficiency. As a result, one or more of the switching valve sets 224 that are in the non-donating mode may be changed to the donating mode. Alternatively, the percentage or fraction of the exhaust that is directed by the switching valve sets 224 to the exhaust manifold 206 (shown in FIG. 3) may be reduced, or the percentage or fraction of exhaust that is directed to the EGR manifold 220 (shown in FIG. 3) may be increased. Increasing the number of switching valve sets 224 in the donating mode, reducing the percentage of exhaust that is directed to the exhaust manifold 206, and/or increasing the percentage of exhaust that is directed to the EGR manifold 220 may reduce the efficiency of the diesel engine 108, but also may reduce the emissions of pollutants from the diesel engine 108.

Conversely, if the efficiency measurement does not exceed an efficiency threshold, then the efficiency measurement may indicate that the diesel engine 108 (shown in FIG. 1) is operating at an insufficient efficiency, or an efficiency that needs to be increased. As a result, one or more of the switching valve sets 224 (shown in FIG. 3) that are in the donating mode may be changed to the non-donating mode. Alternatively, the percentage or fraction of exhaust that is directed by the switching valve sets 224 to the EGR manifold 220 (shown in FIG. 3) may be decreased such that a larger percentage of the exhaust is directed to the exhaust manifold 206 (shown in FIG. 3). Increasing the number of switching valve sets 224 that are in the non-donating mode, increasing the percentage of exhaust that is directed to the exhaust manifold 206, and/or reducing the percentage of exhaust that is directed to the EGR manifold 220 may increase the efficiency of the diesel engine 108, but also may increase the emission of pollutants from the diesel engine 108.

In another example, if the emissions parameter includes an exhaust volume flow rate of the diesel engine 108 (shown in FIG. 1) that exceeds an upper exhaust volume flow rate limit, then the emissions parameter may indicate that the diesel engine 108 is emitting too much exhaust into the external atmosphere. As a result, one or more of the switching valve sets 224 (shown in FIG. 3) that are in the non-donating mode may be changed to the donating mode, the percentage of exhaust that is directed to the EGR manifold 220 (shown in FIG. 3) by the switching valve sets 224 may be increased, and/or the percentage of exhaust that is directed to the exhaust manifold 206 (shown in FIG. 3) may be reduced. Increasing the number of switching valve sets 224 in the donating mode, increasing the flow of exhaust to the EGR manifold 220, and/or reducing the flow of exhaust to the exhaust manifold 206 may reduce the emissions of pollutants from the diesel engine 108.

In another example, if the emissions parameter does not exceed a lower exhaust volume flow rate limit, then the emissions parameter may indicate that the diesel engine 108 (shown in FIG. 1) can increase the exhaust volume flow rate, or the flow rate of exhaust generated by the engine 108. As a result, one or more of the switching valve sets 224 that are in the donating mode may be changed to the non-donating mode, the percentage of exhaust that is directed to the EGR manifold 220 (shown in FIG. 3) by the switching valve sets 224 may be decreased, and/or the percentage of exhaust that is directed to the exhaust manifold 206 (shown in FIG. 3) may be increased. Increasing the number of switching valve sets 224 that are in the non-donating mode, decreasing the exhaust directed to the EGR manifold 220, and/or increasing the exhaust directed to the exhaust manifold 206 may increase the emission of pollutants from the diesel engine 108.

Alternatively, the number of switching valve sets 224 (shown in FIG. 3) that are in the donating mode and/or the percentage of exhaust that is directed into the EGR manifold 220 (shown in FIG. 3) by the switching valve sets 224 may be based on a difference between the upper and lower exhaust volume flow rate limits. As the difference increases, the number of switching valve sets 224 that are in the non-donating mode increases while the number of switching valve sets 224 that are in the donating mode decreases in one embodiment. Alternatively, as the difference in exhaust volume flow limits increases, the percentage of exhaust that is directed to the exhaust manifold 206 (shown in FIG. 3) may increase while the percentage of exhaust directed to the EGR manifold 220 decreases. Conversely, as the difference in exhaust volume flow limits decreases, the number of switching valve sets 224 that are in the non-donating mode may decrease while the number of switching valve sets 224 that are in the donating mode may increase. Alternatively, as the difference in exhaust volume flow limits decreases, the percentage of exhaust that is directed to the exhaust manifold 206 may decrease while the percentage of exhaust directed to the EGR manifold 220 increases.

In another example, if the load demand and/or speed demand does not exceed an associated threshold, then the relatively low load and/or speed demand may indicate that the power output of the diesel engine 108 (shown in FIG. 1) needs to be increased. As a result, one or more of the switching valve sets 224 (shown in FIG. 3) that are in the donating mode may be changed to the non-donating mode. Increasing the number of switching valve sets 224 that are in the non-donating mode may increase the power output of the diesel engine 108. Alternatively, the percentage of exhaust that is directed to the EGR manifold 220 (shown in FIG. 3) instead of the exhaust manifold 206 (shown in FIG. 3) by the switching valve sets 224 may be increased.

In another example, if the temperature of the exhaust exceeds a temperature threshold, then the relatively high temperature of the exhaust may indicate that the exhaust of too many donating cylinders 202 (shown in FIG. 3) is being recirculated back to the donating and non-donating cylinders 202, 200 (shown in FIG. 3). As a result, one or more of the switching valve sets 224 (shown in FIG. 3) that are in the non-donating mode may be changed to the donating mode and/or the percentage of exhaust that is directed to the exhaust manifold 206 (shown in FIG. 3) instead of the EGR manifold 220 (shown in FIG. 3) may be increased by the switching valve sets 224. Increasing the number of switching valve sets 224 that are in the donating mode and/or decreasing the percentage of exhaust that is directed to the EGR manifold 220 may reduce the temperature of the exhaust as less exhaust is being recirculated.

In another example, if the pressure of the exhaust exceeds a pressure threshold, then the relatively high pressure of the exhaust may indicate that too much exhaust of too many donating cylinders 202 (shown in FIG. 3) is being recirculated back to the donating and non-donating cylinders 202, 200 (shown in FIG. 3). As a result, one or more of the switching valve sets 224 (shown in FIG. 3) that are in the donating mode may be changed to the non-donating mode and/or the percentage of exhaust that is directed to the EGR manifold 220 (shown in FIG. 3) by the switching valve sets 224 may be decreased. Increasing the number of switching valve sets 224 that are in the non-donating mode and/or reducing the exhaust that is directed to the EGR manifold 220 may reduce the amount and pressure of the exhaust that is being recirculated.

If one or more of the switching valve sets 224 (shown in FIG. 3) in the non-donating mode need to be changed to the donating mode and/or the percentage of exhaust being directed to the EGR manifold 220 (shown in FIG. 3) by the switching valve sets 224 needs to change based on the comparison of the parameters and/or operating conditions with the flow control criteria, then flow of the method 500 proceeds to 516. Alternatively, if one or more of the switching valve sets 224 in the donating mode need to be changed to the non-donating mode and/or the percentage of exhaust being directed to the EGR manifold 220 by the switching valve sets 224 needs to change based on the comparison of the parameters and/or operating conditions with the flow control criteria, then flow of the method 500 also proceeds to 516. Conversely, if the mode of one or more of the switching valve sets 224 does not need to be changed and/or the percentage of exhaust being directed by the switching valve sets 224 does not need to change, then flow of the method 500 proceeds to 518.

At 516, the mode of and/or flow of exhaust being directed by one or more of the switching valve sets 224 (shown in FIG. 3) is changed. For example, based on the comparison of the parameters and/or operating conditions with the flow control criteria, the number of switching valve sets 224 that are in the donating mode may be changed so that a different number of the switching valve sets 224 are in the donating mode. Alternatively, the percentage of exhaust directed by the switching valve sets 224 to the EGR manifold 220 (shown in FIG. 3) may be changed. In one embodiment, if the mode of two or more switching valve sets 224 is changed from the donating mode to the non-donating mode, then the switching valve sets 224 are sequentially changed from the donating mode to the non-donating mode. For example, the mode of one switching valve set 224 is changed before the mode of the other switching valve(s) 224 is changed. Serially or sequentially changing the mode of the switching valve sets 224 may prevent significant pressure losses in the switching valve sets 224.

At 518, a determination is made whether to change the exhaust volume flow rate of the exhaust that passes through the switching valve sets 224 (shown in FIG. 3) to the external atmosphere by way of the exhaust manifold 206 (shown in FIG. 3). For example, based on the comparison of the parameters and/or conditions to the flow control criteria, the rate at which the exhaust flows through the switching valve sets 224 to the exhaust manifold 206 may need to be changed. In one embodiment, if the efficiency parameter includes an efficiency measurement of the diesel engine 108 (shown in FIG. 1) that exceeds an efficiency threshold, then the efficiency measurement may indicate that the diesel engine 108 is operating at a sufficiently high efficiency. As a result, the volume flow rate of the exhaust passing through one or more of the switching valve sets 224 to the exhaust manifold 206 may be increased. Increasing the flow rate of exhaust through the switching valve sets 224 to the exhaust manifold 206 may increase the efficiency of the diesel engine 108. Conversely, if the efficiency measurement does not exceed an efficiency threshold, then the efficiency measurement may indicate that the diesel engine 108 is operating at an insufficient efficiency, or an efficiency that needs to be increased. As a result, the volume flow rate of exhaust passing through one or more of the switching valve sets 224 to the exhaust manifold 206 may be increased. Increasing the volume flow rate of exhaust passing through the exhaust manifold 206 may increase the efficiency of the diesel engine 108.

In another example, if the emissions parameter includes an exhaust volume flow rate of the diesel engine 108 (shown in FIG. 1) that exceeds an upper exhaust volume flow rate limit, then the emissions parameter may indicate that the volume flow rate of the exhaust that is flowing into the exhaust manifold 206 (shown in FIG. 3) is too large. As a result, the volume flow rate of the exhaust passing through one or more of the switching valve sets 224 (shown in FIG. 3) to the exhaust manifold 206 may be decreased. Decreasing the flow rate of exhaust that passes through the switching valve sets 224 to the exhaust manifold 206 may reduce the emissions of pollutants from the diesel engine 108. In another example, if the emissions parameter does not exceed a lower exhaust volume flow rate limit, then the emissions parameter may indicate that the volume flow rate of the exhaust that is passing through the switching valve sets 224 to the exhaust manifold 206 can be increased.

Alternatively, the flow rate of exhaust that passes through the switching valve sets 224 (shown in FIG. 3) to the exhaust manifold 206 (shown in FIG. 3) may be based on a difference between the upper and lower exhaust volume flow rate limits. As the difference increases, the exhaust volume flow rate through the switching valve sets 224 and to the exhaust manifold 206 increases in one embodiment. As the difference decreases, the exhaust volume flow rate through the switching valve sets 224 and to the exhaust manifold 206 may decrease.

In another example, if the load demand and/or speed demand does not exceed an associated threshold, then the relatively low load and/or speed demand may indicate that the power output of the diesel engine 108 (shown in FIG. 1) needs to be increased. As a result, the volume flow rate of the exhaust that passes through one or more of the switching valve sets 224 (shown in FIG. 3) to the exhaust manifold 206 (shown in FIG. 3) may be increased. Increasing the exhaust volume flow rate to the exhaust manifold 206 through the switching valve sets 224 may increase the power output of the diesel engine 108.

In another example, if the temperature of the exhaust exceeds a temperature threshold, then the relatively high temperature of the exhaust may indicate that too much exhaust is being recirculated back to the donating and non-donating cylinders 202, 200 (shown in FIG. 3). As a result, the flow rate of exhaust to the exhaust manifold 206 (shown in FIG. 3) through one or more of the switching valve sets 224 (shown in FIG. 3) may be increases. Increasing the exhaust volume flow rate that passes to the exhaust manifold 206 can reduce the recirculated exhaust and the temperature of the exhaust.

In another example, if the pressure of the exhaust exceeds a pressure threshold, then the relatively high pressure of the exhaust may indicate that the exhaust volume flow rate that passes to the exhaust manifold 206 (shown in FIG. 3) through the switching valve sets 224 (shown in FIG. 3) is too small. As a result, the exhaust volume flow rate passing through the switching valve sets 224 to the exhaust manifold 206 may be increased. Increasing the exhaust volume flow rate that passes through the switching valve sets 224 to the exhaust manifold 224 may reduce the amount and pressure of the exhaust that is being recirculated.

If the volume flow rate of the exhaust passing to the exhaust manifold 206 (shown in FIG. 3) through one or more of the switching valve sets 224 (shown in FIG. 3) needs to be changed based on the comparison of the parameters and/or operating conditions with the flow control criteria, then flow of the method 500 proceeds to 520. Alternatively, if the volume flow rate of the exhaust passing to the exhaust manifold 206 through one or more of the switching valve sets 224 does not need to change, based on the comparison of the parameters and/or operating conditions with the flow control criteria, then flow of the method 500 returns to 502.

At 520, the exhaust volume flow rate through one or more of the switching valve sets 224 (shown in FIG. 3) is changed. For example, based on the comparison of the parameters and/or operating conditions with the flow control criteria, the flow rate of exhaust passing through one or more of the switching valve sets 224 to the exhaust manifold 206 (shown in FIG. 3) may be changed. In one embodiment, the flow rate of exhaust through one or more of the switching valve sets 224 may be varied by moving the plug 414 (shown in FIG. 4) in the conduit 402 (shown in FIG. 4) of the throttle valve 400 (shown in FIG. 4).

The method 500 may proceed in a loop-wise manner back to 502, where the donating and non-donating cylinders continue to be operated. The method 500 may proceed to change the number of switching valve sets 224 (shown in FIG. 3) and/or the exhaust volume flow rate that passes through the switching valve sets 224 to the exhaust manifold 206 (shown in FIG. 3) in order to reduce the emission of pollutants while avoiding significant reductions in the efficiency of the diesel engine 108 (shown in FIG. 1).

It is to be understood that the above description is intended to be illustrative, and not restrictive. For example, the above-described embodiments (and/or aspects thereof) may be used in combination with each other. In addition, many modifications may be made to adapt a particular situation or material to the teachings of the subject matter set forth herein without departing from its scope. While the dimensions and types of materials described herein are intended to define the parameters of the disclosed subject matter, they are by no means limiting and are exemplary embodiments. Many other embodiments will be apparent to those of skill in the art upon reviewing the above description. The scope of the subject matter described herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose several embodiments of the subject matter set forth herein, including the best mode, and also to enable any person skilled in the art to practice the embodiments of disclosed subject matter, including making and using any devices or systems and performing any incorporated methods. The patentable scope of the subject matter described herein is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A diesel engine system comprising:

a cylinder having a piston disposed within a combustion chamber, the combustion chamber receiving intake air and fuel to combust the fuel and move the piston within the combustion chamber;

an exhaust manifold fluidly coupled with the cylinder, the exhaust manifold directing exhaust generated in the combustion chamber to an exhaust outlet that delivers the exhaust to an external atmosphere;

an exhaust gas recirculation (EGR) manifold fluidly coupled with the cylinder, the EGR manifold configured to recirculate the exhaust generated in the combustion chamber back to the combustion chamber as at least part of the intake air that is received by the combustion chamber;

a valve disposed between the combustion chamber of the cylinder and the exhaust manifold and between the combustion chamber and the EGR manifold, the valve having a donating mode and a non-donating mode, the valve fluidly coupling the combustion chamber with the EGR manifold when the valve is in the donating mode, the valve fluidly coupling the combustion chamber with the exhaust manifold when the valve is in the non-donating mode; and a plurality of the cylinders, a plurality of the valves, and a control module communicatively coupled with the plurality of valves, the control module changing a number of the valves that are in the donating mode based on at least one of the efficiency parameter, the emissions parameter, or the operating condition of the plurality of the cylinders.

2. A diesel engine system comprising:

a cylinder having a piston disposed within a combustion chamber, the combustion chamber receiving intake air and fuel to combust the fuel and move the piston within the combustion chamber;

an exhaust manifold fluidly coupled with the cylinder, the exhaust manifold directing exhaust generated in the combustion chamber to an exhaust outlet that delivers the exhaust to an external atmosphere;

an exhaust gas recirculation (EGR) manifold fluidly coupled with the cylinder, the EGR manifold configured to recirculate the exhaust generated in the combustion chamber back to the combustion chamber as at least part of the intake air that is received by the combustion chamber; and a valve disposed between the combustion chamber of the cylinder and the exhaust manifold and between the combustion chamber and the EGR manifold, the valve having a donating mode and a non-donating mode, the valve fluidly coupling the combustion chamber with the EGR manifold when the valve is in the donating mode, the valve fluidly coupling the combustion chamber with the exhaust manifold when the valve is in the non-donating mode, wherein the cylinder is a donating cylinder, the piston is a first piston, and the combustion chamber is a first combustion chamber, further comprising a non-donating cylinder having a second piston disposed within a second combustion chamber, the second combustion chamber receiving the intake air and the fuel to combust the fuel and move the second piston within the second combustion chamber, the second combustion chamber fluidly coupled with the EGR manifold to receive the exhaust from the donating cylinder as at least part of the intake air received by the non-donating cylinder.

3. A diesel engine system comprising:

a cylinder having a piston disposed within a combustion chamber, the combustion chamber receiving intake air and fuel to combust the fuel and move the piston within the combustion chamber;

an exhaust manifold fluidly coupled with the cylinder, the exhaust manifold directing exhaust generated in the combustion chamber to an exhaust outlet that delivers the exhaust to an external atmosphere;

an exhaust gas recirculation (EGR) manifold fluidly coupled with the cylinder, the EGR manifold configured to recirculate the exhaust generated in the combustion chamber back to the combustion chamber as at least part of the intake air that is received by the combustion chamber; and a valve disposed between the combustion chamber of the cylinder and the exhaust manifold and between the combustion chamber and the EGR manifold, the valve having a donating mode and a non-donating mode, the valve fluidly coupling the combustion chamber with the EGR manifold when the valve is in the donating mode, the valve fluidly coupling the combustion chamber with the exhaust manifold when the valve is in the non-donating mode, wherein the cylinder is a donating cylinder, the piston is a first piston, and the combustion chamber is a first combustion chamber, further comprising a non-donating cylinder having a second piston disposed within a second combustion chamber, the second combustion chamber receiving the intake air and the fuel to combust and move the second piston within the second combustion chamber, the second combustion chamber fluidly coupled with the exhaust manifold to direct exhaust from the non-donating cylinder into the external atmosphere.

4. A diesel engine system comprising:

a cylinder having a piston disposed within a combustion chamber, the combustion chamber receiving intake air and fuel to combust the fuel and move the piston within the combustion chamber;

an exhaust manifold fluidly coupled with the cylinder, the exhaust manifold directing exhaust generated in the combustion chamber to an exhaust outlet that delivers the exhaust to an external atmosphere;

an exhaust gas recirculation (EGR) manifold fluidly coupled with the cylinder, the EGR manifold configured to recirculate the exhaust generated in the combustion chamber back to the combustion chamber as at least part of the intake air that is received by the combustion chamber; and a valve disposed between the combustion chamber of the cylinder and the exhaust manifold and between the combustion chamber and the EGR manifold, the valve having a donating mode and a non-donating mode, the valve fluidly coupling the combustion chamber with the EGR manifold when the valve is in the donating mode, the valve fluidly coupling the combustion chamber with the exhaust manifold when the valve is in the non-donating mode, wherein the valve is a throttle valve having a conical plug moveable within a conduit of the throttle valve, the conical plug moving within the conduit to open or close the throttle valve while reducing a pressure loss of the exhaust in the throttle valve.

5. A control method for a diesel engine system, the method comprising:

directing exhaust generated in a combustion chamber of a cylinder in the diesel engine system to a valve disposed between and fluidly coupled with the combustion chamber and each of an exhaust manifold and an exhaust gas recirculation (EGR) manifold, the valve switchable between a donating mode and a non-donating mode;

directing the exhaust from the cylinder through the exhaust manifold to an external atmosphere when the valve is in the non-donating mode;

recirculating the exhaust back to the combustion chamber as at least part of intake air that is injected into the combustion chamber when the valve is in the donating mode; and a plurality of the cylinders, a plurality of the valves, and a control module communicatively coupled with the plurality of valves, the control module changing a number of the valves that are in the donating mode based on at least one of an efficiency threshold, an emissions limit, a load demand of the plurality of the cylinders, a speed demand of the plurality of the cylinders, a pressure of the exhaust flowing from the plurality of the cylinders, or a temperature of the exhaust flowing from the plurality of the cylinders.

6. A control method for a diesel engine system, the method comprising:

directing exhaust generated in a combustion chamber of a cylinder in the diesel engine system to a valve disposed between and fluidly coupled with the combustion chamber and each of an exhaust manifold and an exhaust gas recirculation (EGR) manifold, the valve switchable between a donating mode and a non-donating mode;

directing the exhaust from the cylinder through the exhaust manifold to an external atmosphere when the valve is in the non-donating mode; and recirculating the exhaust back to the combustion chamber as at least part of intake air that is injected into the combustion chamber when the valve is in the donating mode, wherein the injecting comprises injecting the intake air and the fuel into the combustion chambers of a plurality of the cylinders and the directing the exhaust generated in the combustion chambers comprises directing the exhaust generated in the combustion chambers to a plurality of the valves, further comprising switching a subset of the plurality of valves to the donating mode based on at least one of an upper exhaust volume flow rate or a lower exhaust volume flow rate.

7. A control method for a diesel engine system, the method comprising:

directing exhaust generated in a combustion chamber of a cylinder in the diesel engine system to a valve disposed between and fluidly coupled with the combustion chamber and each of an exhaust manifold and an exhaust gas recirculation (EGR) manifold, the valve switchable between a donating mode and a non-donating mode;

directing the exhaust from the cylinder through the exhaust manifold to an external atmosphere when the valve is in the non-donating mode; and recirculating the exhaust back to the combustion chamber as at least part of intake air that is injected into the combustion chamber when the valve is in the donating mode, wherein the cylinder is a donating cylinder and the combustion chamber is a first combustion chamber, the recirculating comprising directing the exhaust from the donating cylinder to a second combustion chamber of a non-donating cylinder as at least part of intake air that is injected into the second combustion chamber of the non-donating cylinder.

8. The control method of claim 7, further comprising directing exhaust generated by the non-donating cylinder through the exhaust manifold to the external atmosphere.

9. A tangible and non-transitory computer readable storage medium comprising instructions for a control module of a diesel engine system, the instructions directing the control module to:

monitor at least one of an efficiency parameter, an emissions parameter, or an operating condition of a cylinder of the diesel engine system having a piston disposed in a combustion chamber that receives intake air and diesel fuel to combust the diesel fuel and move the piston; and switch a valve between a non-donating mode and a donating mode based on the at least one of the efficiency parameter, the emissions parameter, or the operating condition, the valve disposed between the combustion chamber of the cylinder and fluidly coupled with the combustion chamber and each of an exhaust manifold and an exhaust gas recirculation (EGR) manifold, the valve switchable between a donating mode and a non-donating mode, wherein, when the valve is in the non-donating mode, exhaust generated in the combustion chamber is directed through the exhaust manifold to an external atmosphere and, when the valve is in the donating mode, the exhaust is recirculated back to the combustion chamber as at least part of the intake air that is injected into the combustion chamber, wherein the operating condition includes at least one of a load demand of the cylinder, a speed demand of the cylinder, a pressure of the exhaust generated by the cylinder, or a temperature of exhaust generated by the cylinder.

10. The computer readable storage medium of claim 9, wherein the instructions direct the control module to measure at least one of an exhaust volume flow rate or a pollutant concentration of the exhaust generated in the cylinder as the emissions parameter.

11. The computer readable storage medium of claim 9, wherein the instructions direct the control module to monitor at least one of the efficiency parameter, the emissions parameter, or the operating condition of a plurality of the cylinders and switch at least one of the plurality of the cylinders between the non-donating mode and the donating mode based on at least one of the efficiency parameter, the emissions parameter, or the operating condition.

12. A diesel engine system comprising:

a cylinder having a piston disposed within a combustion chamber, the combustion chamber receiving intake air and fuel to combust the fuel and move the piston within the combustion chamber;

an exhaust manifold fluidly coupled with the cylinder, the exhaust manifold directing exhaust generated in the combustion chamber to an exhaust outlet that delivers the exhaust to an external atmosphere;

an exhaust gas recirculation (EGR) manifold fluidly coupled with the cylinder, the EGR manifold configured to recirculate the exhaust generated in the combustion chamber back to the combustion chamber as at least part of the intake air that is received by the combustion chamber;

a valve disposed between the combustion chamber of the cylinder and the exhaust manifold and between the combustion chamber and the EGR manifold, the valve having a donating mode and a non-donating mode, the valve fluidly coupling the combustion chamber with the EGR manifold when the valve is in the donating mode, the valve fluidly coupling the combustion chamber with the exhaust manifold when the valve is in the non-donating mode; and a plurality of the cylinders and a plurality of the valves, wherein a number of the plurality of the valves that are in the donating mode is based on at least one of an upper exhaust volume flow rate limit or a lower exhaust volume flow rate limit.

13. The diesel engine system of claim 1, further comprising a plurality of the cylinders, a plurality of the valves, and a control module communicatively coupled with the plurality of valves, the control module changing a number of the valves that are in the donating mode based on at least one of the efficiency parameter, the emissions parameter, or the operating condition of the plurality of the cylinders.

14. The diesel engine system of claim 1, wherein the cylinder is a donating cylinder, the piston is a first piston, and the combustion chamber is a first combustion chamber, further comprising a non-donating cylinder having a second piston disposed within a second combustion chamber, the second combustion chamber receiving the intake air and the fuel to combust the fuel and move the second piston within the second combustion chamber, the second combustion chamber fluidly coupled with the EGR manifold to receive the exhaust from the donating cylinder as at least part of the intake air received by the non-donating cylinder.

15. The diesel engine system of claim 1, wherein the cylinder is a donating cylinder, the piston is a first piston, and the combustion chamber is a first combustion chamber, further comprising a non-donating cylinder having a second piston disposed within a second combustion chamber, the second combustion chamber receiving the intake air and the fuel to combust and move the second piston within the second combustion chamber, the second combustion chamber fluidly coupled with the exhaust manifold to direct exhaust from the non-donating cylinder into the external atmosphere.

16. The diesel engine system of claim 1, wherein the valve is a throttle valve having a conical plug moveable within a conduit of the throttle valve, the conical plug moving within the conduit to open or close the throttle valve while reducing a pressure loss of the exhaust in the throttle valve.

17. The diesel engine system of claim 12, wherein the valve changes a percentage of the exhaust that is directed to the EGR manifold based on at least one of an efficiency parameter, an emissions parameter, or an operating condition of the cylinder.

18. The diesel engine system of claim 17, wherein the operating condition includes at least one of a load demand of the cylinder, a speed demand of the cylinder, a pressure of the exhaust generated by the cylinder, or a temperature of the exhaust generated by the cylinder.

19. A control method for a diesel engine system, the method comprising:

directing exhaust generated in a combustion chamber of a cylinder in the diesel engine system to a valve disposed between and fluidly coupled with the combustion chamber and each of an exhaust manifold and an exhaust gas recirculation (EGR) manifold, the valve switchable between a donating mode and a non-donating mode;

directing the exhaust from the cylinder through the exhaust manifold to an external atmosphere when the valve is in the non-donating mode;

recirculating the exhaust back to the combustion chamber as at least part of intake air that is injected into the combustion chamber when the valve is in the donating mode; and switching the valve between the non-donating mode and the donating mode based on at least one of an upper exhaust volume flow rate limit or a lower exhaust volume flow rate limit.

20. The control method of claim 19, further comprising a plurality of the cylinders, a plurality of the valves, and a control module communicatively coupled with the plurality of valves, the control module changing a number of the valves that are in the donating mode based on at least one of an efficiency threshold, an emissions limit, a load demand of the plurality of the cylinders, a speed demand of the plurality of the cylinders, a pressure of the exhaust flowing from the plurality of the cylinders, or a temperature of the exhaust flowing from the plurality of the cylinders.

21. The control method of claim 19, wherein the injecting comprises injecting the intake air and the fuel into the combustion chambers of a plurality of the cylinders and the directing the exhaust generated in the combustion chambers comprises directing the exhaust generated in the combustion chambers to a plurality of the valves, further comprising switching a subset of the plurality of valves to the donating mode based on at least one of an upper exhaust volume flow rate or a lower exhaust volume flow rate.

22. The control method of claim 19, further comprising changing a percentage of exhaust directed by the valve to the EGR manifold based on at least one of an efficiency parameter, an emissions parameter, or an operating condition of the cylinder.

23. The control method of claim 22, wherein the operating condition includes at least one of a load demand of the cylinder, a speed demand of the cylinder, a pressure of the exhaust generated by the cylinder, or a temperature of the exhaust generated by the cylinder.

24. The control method of claim 19, wherein the cylinder is a donating cylinder and the combustion chamber is a first combustion chamber, the recirculating comprising directing the exhaust from the donating cylinder to a second combustion chamber of a non-donating cylinder as at least part of intake air that is injected into the second combustion chamber of the non-donating cylinder.

25. The control method of claim 24, further comprising directing exhaust generated by the non-donating cylinder through the exhaust manifold to the external atmosphere.

* * * * *

UNITED STATES PATENT AND TRADEMARK OFFICE

CERTIFICATE OF CORRECTION

PATENT NO. : 8,528,530 B2
APPLICATION NO. : 12/827251
DATED : September 10, 2013
INVENTOR(S) : Freund et al.

It is certified that error appears in the above-identified patent and that said Letters Patent is hereby corrected as shown below:

In the Claims

In Column 22, Line 13, in Claim 9, delete “of exhaust” and insert -- of the exhaust --, therefor.

Signed and Sealed this
Twenty-ninth Day of October, 2013

Teresa Stanek Rea
*Deputy Director of the United States Patent and Trademark Office*